US010704518B2

(12) United States Patent
Yasukawa et al.

(10) Patent No.: US 10,704,518 B2
(45) Date of Patent: Jul. 7, 2020

(54) SPARK-IGNITION DIRECT FUEL INJECTION VALVE

(71) Applicant: Hitachi Automotive Systems, Ltd., Hitachinaka-shi, Ibaraki (JP)

(72) Inventors: Yoshihito Yasukawa, Hitachinaka (JP); Kiyotaka Ogura, Hitachinaka (JP); Takao Miyake, Hitachinaka (JP); Eiji Ishii, Tokyo (JP); Motoyuki Abe, Tokyo (JP); Tohru Ishikawa, Hitachinaka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 16/012,275

(22) Filed: Jun. 19, 2018

(65) Prior Publication Data

US 2018/0363615 A1 Dec. 20, 2018

Related U.S. Application Data

(63) Continuation of application No. 15/591,218, filed on May 10, 2017, now Pat. No. 10,024,288, which is a (Continued)

(30) Foreign Application Priority Data

Mar. 26, 2012 (JP) ..... 2012-068613

(51) Int. Cl.
*F02M 69/04* (2006.01)
*F02M 61/18* (2006.01)
(Continued)

(52) U.S. Cl.
CPC .... *F02M 61/1813* (2013.01); *F02M 51/0671* (2013.01); *F02M 51/0675* (2013.01); *F02M 61/1833* (2013.01); *F02M 67/12* (2013.01)

(58) Field of Classification Search
CPC ..... F02M 61/1806; F02M 61/1833; F02M 61/1813; F02M 45/086; F02M 61/18; F02M 61/182; F02M 21/0263
(Continued)

(56) References Cited

U.S. PATENT DOCUMENTS 4,069,978 A * 1/1978 El Moussa ..... F02M 61/1806 219/121.13
5,029,759 A 7/1991 Weber
(Continued)

FOREIGN PATENT DOCUMENTS

DE 10 2006 000 418 A1 3/2007
JP H05-231268 A 9/1993
(Continued)

OTHER PUBLICATIONS

Japanese Office Action dated Aug. 30, 2017 and English translation issued in corresponding application No. 2016-123768.
(Continued)

*Primary Examiner* — Long T Tran
*Assistant Examiner* — James J Kim
(74) *Attorney, Agent, or Firm* — Foley & Lardner LLP

(57) ABSTRACT

A spark-ignition direct fuel injection valve includes, at least, a seat member provided with a fuel injection hole and a valve seat and a valve body which controls fuel injection from the injection hole by contacting and separating from the valve seat. In the spark-ignition direct fuel injection valve: the injection hole has an injection hole inlet which is open inwardly of the seat member and an injection hole outlet which is open outwardly of the seat member; an opening edge of the injection hole inlet has a first round-chamfered portion formed on an upstream side with respect to a fuel flow toward the injection hole inlet; and an
(Continued)

extending length (L) of the injection hole does not exceed three times a hole diameter (D) of the injection hole.

3 Claims, 15 Drawing Sheets

Related U.S. Application Data continuation of application No. 14/379,973, filed as application No. PCT/JP2012/081730 on Dec. 7, 2012, now Pat. No. 9,677,526.

(51) Int. Cl.
*F02M 51/06* (2006.01)
*F02M 67/12* (2006.01)

(58) Field of Classification Search
USPC ..... 123/445; 239/533.2, 533.12, 584
See application file for complete search history.

(56) References Cited

U.S. PATENT DOCUMENTS

| | | | | |
|---|---|---|---|---|
| 5,752,316 | A | 5/1998 | Takagi et al. | |
| 5,875,973 | A | 3/1999 | Filiz et al. | |
| 5,934,571 | A * | 8/1999 | Schmidt | F02M 45/083 239/533.12 |
| 6,520,145 | B2 * | 2/2003 | Hunkert | F02M 61/1806 123/305 |
| 6,644,565 | B2 | 11/2003 | Hockenberger | |
| 7,484,494 | B2 | 2/2009 | Lippert et al. | |
| 7,726,590 | B2 | 6/2010 | Von Bacho et al. | |
| 8,011,600 | B2 | 9/2011 | Gray, Jr. | |
| 8,191,800 | B2 * | 6/2012 | Kitagawa | F02M 51/061 239/533.12 |
| 8,544,770 | B2 | 10/2013 | Limmer et al. | |
| 9,677,526 | B2 | 6/2017 | Yasukawa et al. | |
| 2004/0262430 | A1 | 12/2004 | Joseph | |
| 2005/0252483 | A1 | 11/2005 | Ganz et al. | |
| 2005/0258277 | A1 | 11/2005 | Joseph | |
| 2007/0012805 | A1 * | 1/2007 | Maier | F02M 51/0671 239/533.12 |
| 2009/0020633 | A1 * | 1/2009 | Limmer | F02M 61/1806 239/533.12 |
| 2009/0025680 | A1 * | 1/2009 | Kihara | F02B 23/104 123/299 |
| 2009/0133668 | A1 | 5/2009 | Ashizawa | |
| 2009/0272824 | A1 * | 11/2009 | Kitagawa | F02M 51/061 239/585.5 |
| 2009/0321540 | A1 | 12/2009 | Heyse et al. | |
| 2010/0070158 | A1 | 3/2010 | Futonagane et al. | |
| 2010/0229832 | A1 | 9/2010 | Millet et al. | |
| 2010/0320293 | A1 * | 12/2010 | Ogura | F02M 51/0685 239/533.12 |
| 2011/0030635 | A1 | 2/2011 | Siuchta et al. | |
| 2011/0042491 | A1 * | 2/2011 | Abe | F02M 61/188 239/584 |
| 2011/0155826 | A1 * | 6/2011 | Kerst | F02M 61/1806 239/584 |
| 2014/0190451 | A1 | 7/2014 | Vorbach | |
| 2014/0224214 | A1 | 8/2014 | Vorbach | |

FOREIGN PATENT DOCUMENTS

| | | | |
|---|---|---|---|
| JP | 10-331747 | A | 12/1998 |
| JP | 2002-357169 | A | 12/2002 |
| JP | 2006-083764 | A | 3/2006 |
| JP | 2006-510843 | A | 3/2006 |
| JP | 2007-085333 | A | 4/2007 |
| JP | 2007-107459 | A | 4/2007 |
| JP | 2007-516374 | A | 6/2007 |
| JP | 2008-064094 | A | 3/2008 |
| JP | 2009-008087 | A1 | 1/2009 |
| JP | 2009-270448 | A | 11/2009 |
| JP | 2010-501784 | A | 1/2010 |
| JP | 2010-112196 | A | 5/2010 |
| JP | 2010-222977 | A | 10/2010 |

OTHER PUBLICATIONS

PCT International Search Report on application PCT/JP2012/081730 dated Feb. 5, 2013; 3 pages.

* cited by examiner

SPARK-IGNITION DIRECT FUEL INJECTION VALVE

CROSS-REFERENCE TO RELATED APPLICATIONS

The present application is a continuation application of U.S. application Ser. No. 15/591,218, filed May 10, 2017, which is a continuation application of U.S. application Ser. No. 14/379,973, filed Aug. 20, 2014, now U.S. Pat. No. 9,677,526, issued Jun. 13, 2017, which is a National Stage application of International Application No. PCT/JP2012/081730, filed Dec. 7, 2012, which claims the benefit of priority from the prior Japanese Patent Application No. 2012-068613, filed Mar. 26, 2012; the entire contents of which are incorporated herein by reference.

TECHNICAL FIELD

The present invention relates to a spark-ignition direct fuel injection valve which is a fuel injection valve for use in an internal combustion engine, for example, a gasoline engine and which prevents fuel leakage by making a valve body contact a valve seat and injects fuel directly into a cylinder by separating the valve body from the valve seat.

BACKGROUND ART

When a fuel injection valve for injecting fuel directly into a cylinder of an internal combustion engine is used, for example, its fuel spray characteristics affect the output characteristics and fuel economy of and the environmental burden caused by the internal combustion engine. A technique has been known in which the spray characteristics of a fuel injection valve are changed by appropriately changing the shape of a fuel injection hole of the fuel injection valve (see Patent Literature 1).

CITATION LIST

Patent Literature

Patent Literature 1: Japanese Patent Application Laid-Open No. Hei 10 (1998)-331747

SUMMARY OF INVENTION

Technical Problem

The fuel injection valve disclosed in the above patent literature is a fuel injection valve for use in a diesel engine. In the fuel injection valve disclosed in the above patent literature, fuel is injected at higher speed to make fuel particles finer. In the case of the fuel injection valve disclosed in the above patent literature, however, the distance of fuel injection (fuel spray length) becomes long to possibly cause, at the time of fuel injection into a cylinder, fuel adhesion to a suction valve or the inner wall surface of the cylinder.

Solution to Problem

The spark-ignition direct fuel injection valve according to claim 1 of the present invention comprises, at least, a seat member provided with a fuel injection hole and a valve seat and a valve body which controls fuel injection from the injection hole by contacting and separating from the valve seat. In the spark-ignition direct fuel injection valve: the injection hole has an injection hole inlet which is open inwardly of the seat member and an injection hole outlet which is open outwardly of the seat member; an opening edge of the injection hole inlet has a first round-chamfered portion formed on an upstream side with respect to a fuel flow toward the injection hole inlet; and an extending length (L) of the injection hole does not exceed three times a hole diameter (D) of the injection hole.

Advantageous Effects of Invention

According to the present invention, at the time of fuel injection into a cylinder, fuel adhesion to a suction valve and the inner wall surface of the cylinder can be suppressed.

DESCRIPTION OF EMBODIMENTS

First Embodiment

Figure 1:
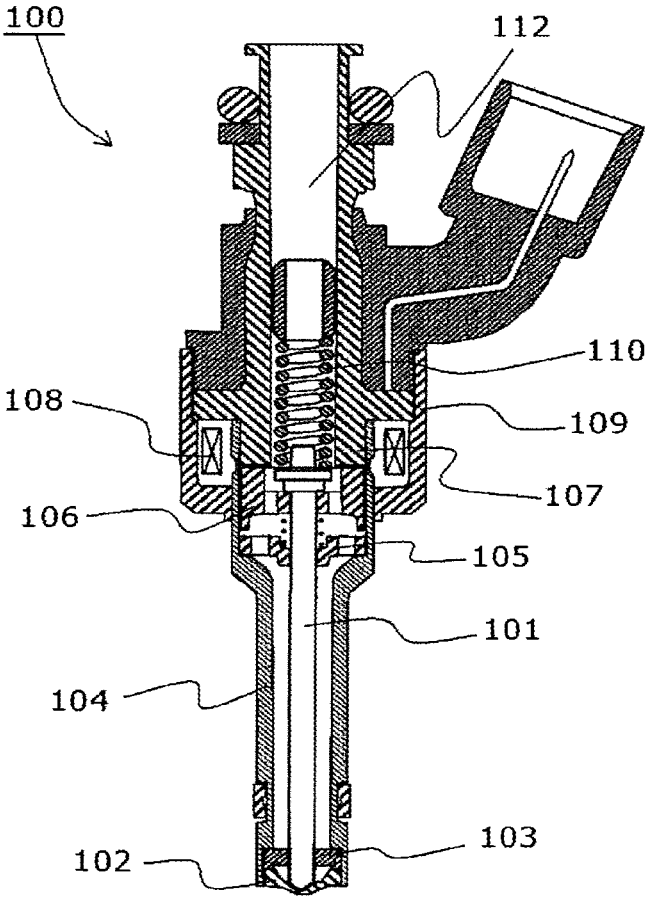
FIG. 1 is a sectional view of an electromagnetic fuel injection valve according to a first embodiment.

A spark-ignition direct fuel injection valve according to a first embodiment of the present invention will be described below with reference to FIGS. 1 to 9. FIG. 1 is a sectional view of an electromagnetic fuel injection valve representing an example of a spark-ignition direct fuel injection valve of the present embodiment. The electromagnetic fuel injection valve 100 is a normally-closed, electromagnetically driven fuel injection valve used in a gasoline engine of a direct fuel injection type. When a coil 108 is de-energized, a valve body 101 is pressed against a seat member 102 by the bias force of a spring 110 thereby sealing fuel. This state is called a valve-closed state.

Fuel is supplied into the electromagnetic fuel injection valve 100 from a fuel supply port 112. For a direct fuel injection valve like the electromagnetic fuel injection valve 100, the supply fuel pressure ranges from 1 MPa to 40 MPa.

Figure 2:
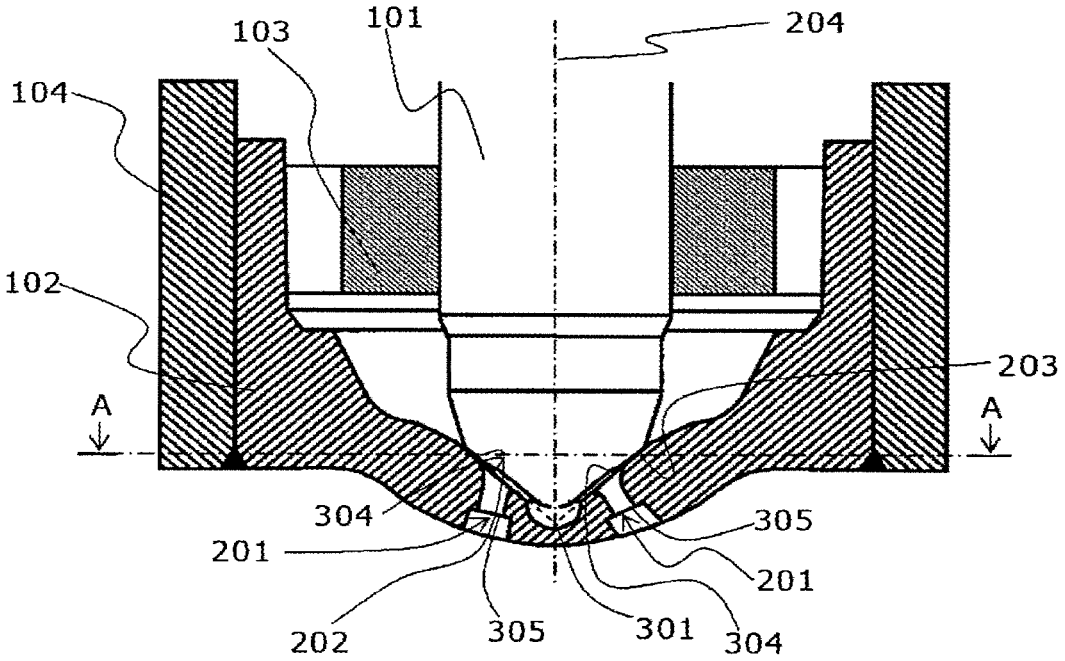
FIG. 2 is an enlarged sectional view of a vicinity of an end portion of an electromagnetic fuel injection valve.

FIG. 2 is an enlarged sectional view of a vicinity of fuel injection holes formed through an end portion of the electromagnetic fuel injection valve 100. A nozzle body 104 is, at an end portion thereof, joined with the seat member 102, for example, by welding. The seat member 102 has an inner conical surface through which plural fuel injection holes 201, being described in detail later, are formed. A conical surface portion upward of, as seen in FIG. 2, the fuel injection holes 201 makes up a valve seat surface 203. In a valve-closed state, the valve body 101 is in contact with the valve seat surface 203 of the seat member 102, thereby sealing fuel. A contact portion 202 (hereinafter referred to as a spherical portion) on the valve body 101 side to contact the valve seat surface 203 is spherically formed. Therefore, the conical valve seat surface 203 and the spherical portion 202 come into linear contact with each other. The axial center of the valve body 101 coincides with a central axis 204 of the electromagnetic fuel injection valve 100.

When the coil 108 shown in FIG. 1 is energized, a core 107, yoke 109, and anchor 106 making up a magnetic circuit in the electromagnetic fuel injection valve 100 generate magnetic fluxes, and a magnetic attraction force is generated in the gap between the core 107 and the anchor 106. When the magnetic attraction force exceeds the total of the bias force of the spring 110 and the fuel pressure, the valve body 101 is attracted by the anchor 106 toward the core 107 while being guided by a guide member 103 and a valve body guide 105 and is displaced upward as seen in the diagram. The resultant state is referred to as a valve-open state.

When the electromagnetic fuel injection valve 100 enters a valve-open state, a gap is formed between the valve seat surface 203 and the spherical portion 202 of the valve body 101 causing fuel injection to be started. When fuel injection is started, the energy provided as the fuel pressure is converted into a kinetic energy. As a result, the fuel reaches the fuel injection holes 201 to be directly injected into a gasoline engine cylinder, not shown.

Shape of Fuel Injection Holes 201

Figure 3:
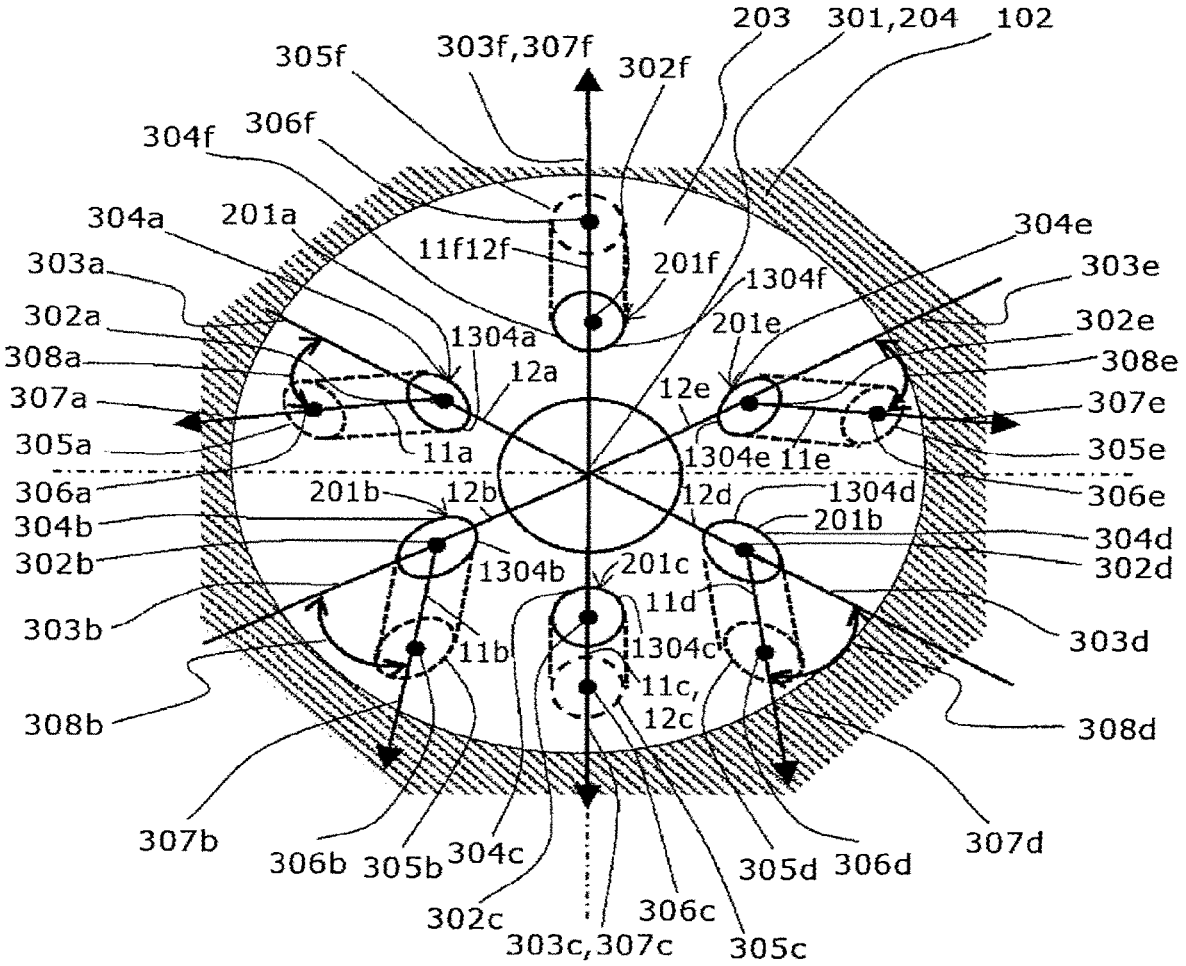
FIG. 3 is a sectional view of a seat member shown in FIG. 2 taken along line A-A.

FIG. 3 is a sectional view of the seat member 102 shown in FIG. 2 taken along line A-A. For descriptive convenience, the valve body 101 is omitted in FIG. 3. Description of the present embodiment is based on an example case in which the number of the fuel injection holes 201 formed through the seat member 102 is six. In the following description, the six fuel injection holes 201 will be individually denoted as 201*a* to 201*f*, respectively, as being ordered, as shown in FIG. 3, counterclockwise about an apex 301 of the valve seat surface 203 with the fuel injection hole 201*a* being approximately in the 10 o'clock position. Also, a portion or a point (position) identical between the fuel injection holes 201 will be represented by a same reference numeral postfixed with a letter (among a to f) identical to the letter postfixed to the reference numeral 201 to represent the corresponding fuel injection hole.

Each fuel injection hole 201 has a fuel injection hole inlet 304 and a fuel injection hole outlet 305. The opening edge of each fuel injection hole inlet 304 is curvedly chamfered. The chamfered portion of each fuel injection hole inlet 304 will be referred to as a round-chamfered portion 1304. Each fuel injection hole outlet 305 is, as shown in FIG. 2, recessed from the outer surface of the seat member 102. Therefore, a portion outside each fuel injection hole outlet 305 (a portion downward of each fuel injection hole outlet 305 as seen in the diagram) of the seat member 102 is cut away so as to prevent interference with the fuel being injected.

The positional relationship between the fuel injection hole inlet 304*a* and the fuel injection hole outlet 305*a* of the fuel injection hole 201*a* will be described below. A plane which contains a line (hereinafter referred to as a nozzle axis or an injection hole axis 307 connecting a center point 302*a* of the fuel injection hole inlet 304*a* and a center point 306*a* of the fuel injection hole outlet 305*a* and which is parallel to the central axis 204 of the electromagnetic fuel injection valve 100 will be referred to as a first plane 11*a*. A plane which contains a line 303*a* connecting the center point 302*a* of the fuel injection hole inlet 304*a* and the apex 301 of the valve seat surface 203 (i.e. the apex of the conical surface) and which also contains the central axis 204 of the electromagnetic fuel injection valve 100 will be referred to as a second plane 12*a*. The fuel injection hole inlet 304*a* and the fuel injection hole outlet 305*a* of the fuel injection hole 201*a* are positioned such that the first plane 11*a* and the second plane 12*a* intersect each other. In other words, the central axis 204 of the electromagnetic fuel injection valve 100 and the injection hole axis 307*a* are in a twisted positional relationship. In FIG. 3, a reference sign 308*a* represents an angle (included angle) formed between the first plane 11*a* and the second plane 12*a*.

For the fuel injection holes 201*b*, 201*d*, and 201*e*, the respective positional relationships between the fuel injection hole inlets 304*b*, 304*d*, and 304*e* and the corresponding fuel injection hole outlets 305*b*, 305*d*, and 305*e* are identical with the positional relationship between the fuel injection hole inlet 304*a* and the fuel injection hole outlet 305*a* of the fuel injection hole 201*a*. Therefore, in the fuel injection hole 201*b*, the first plane 11*b* and the second plane 12*b* intersect each other; in the fuel injection hole 201*d*, the first plane 11*d* and the second plane 12*d* intersect each other; and in the fuel injection hole 201*e*, the first plane 11*e* and the second plane 12*e* intersect each other. That is, the injection hole axes 307*b*, 307*d*, and 307*e* are each in a twisted positional relationship with the central axis 204 of the electromagnetic injection valve 100.

In the fuel injection holes 201*c* and 201*f*, the positional relationships between the fuel injection hole inlets 304*c* and 304*f* and the fuel injection hole outlets 305*c* and 305*f* are as follows. That is, in the fuel injection hole 201*c*, a first plane 11*c* and a second plane 12*c* coincide with each other and, in the fuel injection hole 201*f*, a first plane 11*f* and a second plane 12*f* coincide with each other. Therefore, the included angle between the first plane 11*c* and the second plane 12*c* and the included angle between the first plane 11*f* and the second plane 12*f* are 0 degree. Injection hole axes 307*c* and 307*f* both intersect the central axis 204 of the electromagnetic fuel injection valve 100. Between the fuel injection holes 201*a*, 201*b*, 201*d*, and 201*e* in each of which the included angle is not 0 degree and the fuel injection holes 201*c* and 201*f* in each of which the included angle is 0 degree, there is no difference in the operational effects being described later.

Figure 4:
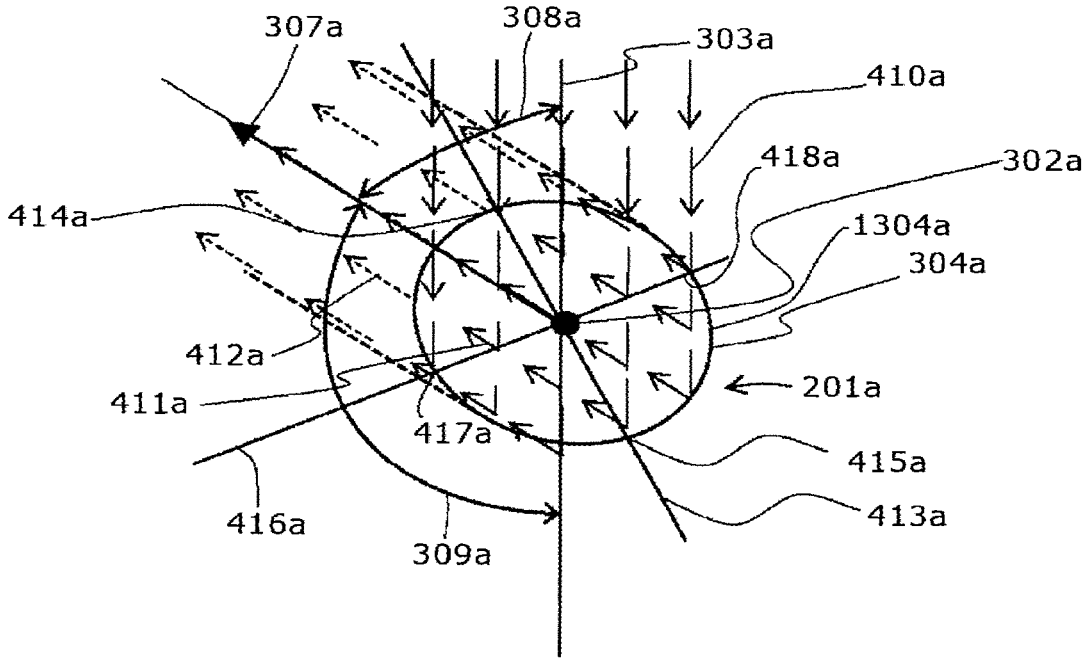
FIG. 4 is a diagram for describing an injection hole shape and a fuel flow.
Figure 5A:
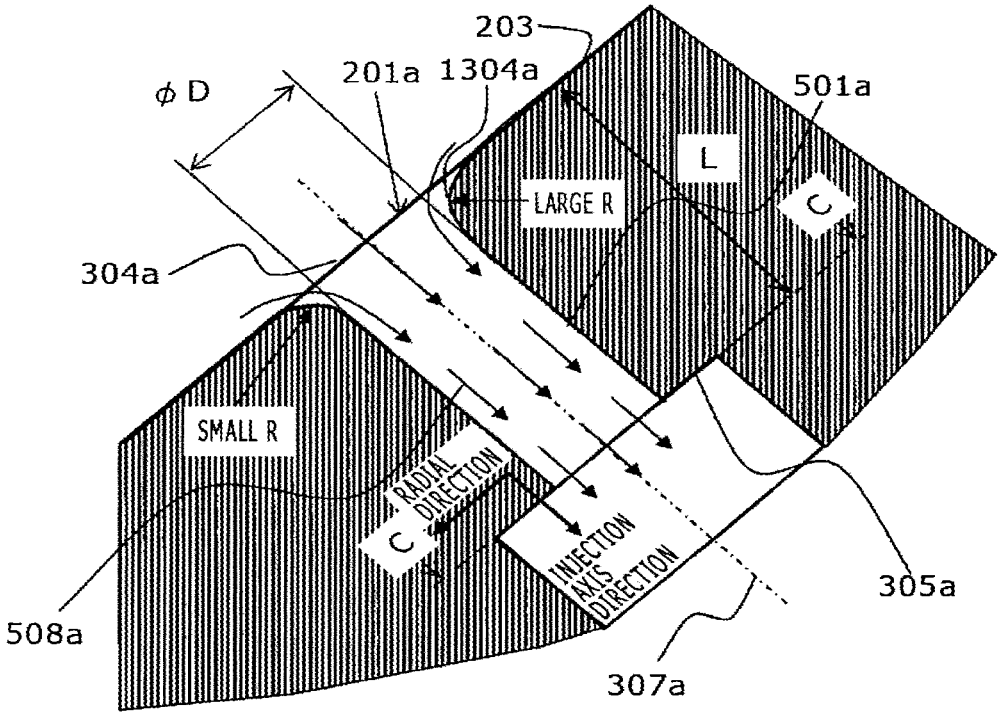
FIG. 5A is a sectional view parallel to a central axis of an electromagnetic fuel injection valve of a fuel injection hole.
Figure 5B:
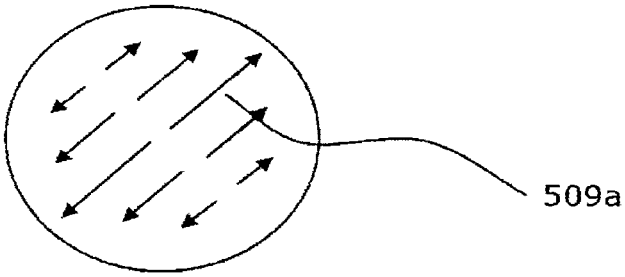
FIG. 5B is a diagram schematically showing velocity components spreading, at a fuel injection hole outlet, in radial directions of the fuel injection hole.
Figure 6:
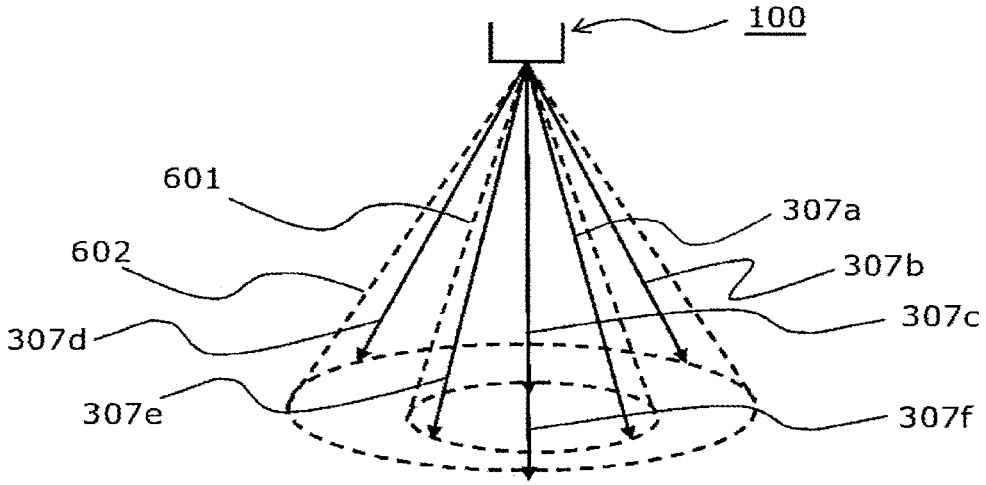
FIG. 6 is a diagram for describing the orientation of each injection hole axis.
Figure 7:
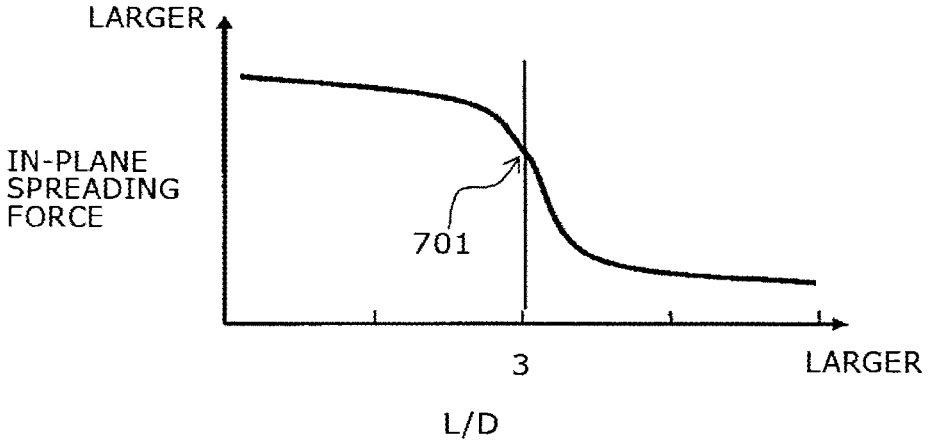
FIG. 7 is a diagram for describing an in-plane spreading force of fuel.

FIG. 4 is a diagram for describing, based on the fuel injection hole 201*a* as an example, the injection hole shape and the fuel flow. FIG. 5A is a sectional view parallel to the central axis 204 of the electromagnetic fuel injection valve 100 of the fuel injection hole 201*a*, as a present example, and schematically shows fuel flows in the fuel injection hole 201*a*. FIG. 5B is a sectional view taken along line C-C in FIG. 5A and schematically shows, out of the fuel velocity components at the fuel injection hole outlet 305*a*, those velocity components spreading in radial directions of the fuel injection hole 201*a*. FIG. 6 is a diagram for describing the orientation of each of the injection hole axes 307*a* to 307*f* of the electromagnetic fuel injection valve 100. FIG. 7 is a diagram for describing, regarding each fuel injection hole, the relationship between the injection hole length divided by the injection hole diameter and the in-plane spreading force of fuel being described later. FIGS. 8 and 9 are diagrams for describing existing techniques and correspond to FIGS. 5A-5B for the present embodiment.

Referring to FIG. 4, reference sign 413*a* denotes a virtual plane bisecting the included angle 308*a* formed between the first plane 11*a* and the second plane 12*a*. Also, regarding the fuel injection hole 201*a*, reference signs 414*a* and 415*a* denote two points where a round-chamfered portion 1304*a* of the fuel injection hole inlet 304*a* and the virtual plane 413*a* intersect each other. Between the two points, the point 414*a* on the upstream side with respect to the fuel flow being described later has a larger curvature radius than that of the point 415*a* on the downstream side with respect to the fuel flow.

In this embodiment, the opening inlet edge of each fuel injection hole 201 is circumferentially round-chamfered such that the upstream point 414*a* is larger in curvature radius than the downstream point 415*a*. The opening inlet edge of each fuel injection hole 201, however, need not necessarily be entirely circumferentially round-chamfered. It may be round-chamfered only where breaking away of the fuel flow becomes intolerably large. Hence, round-chamfering the opening inlet edge of each fuel injection hole 201 on the upstream side only is also allowable. According to the present invention, the opening inlet edge of each fuel injection hole is to be round-chamfered at least on the upstream side.

When, as in the case of the fuel injection hole 201*a*, the included angle 308*a* formed between the first plane 11*a* and the second plane 12*a* is not 0 degree, the fuel flows as described in the following. Though not shown in FIG. 4, the fuel supplied through the fuel supply port 112 into the electromagnetic fuel injection valve 100 flows toward the fuel injection hole inlet 304*a* through the gap formed, in a valve-open state, between the valve seat surface 203 and the spherical portion 202 of the valve body 101 and along the valve seat surface 203. This fuel flow is denoted by a reference sign 410*a*.

The fuel flow 410*a* toward the fuel injection hole inlet 304*a* is turned, at the fuel injection hole inlet 304*a*, into a direction toward the fuel injection hole outlet 305*a*, that is, into the direction of the injection hole axis 307*a* connecting the center point 302*a* of the fuel injection hole inlet 304*a* and the center point 306*a* of the fuel injection hole outlet 305*a*. This fuel flow is denoted by a reference sign 411*a*. Subsequently, the fuel flows inside the fuel injection hole 201*a* toward the fuel injection hole outlet 305*a*, not shown in FIG. 4. This fuel flow is denoted by a reference sign 412*a*.

Regarding the fuel flows 410*a* to 412*a*, the fuel changes its flow direction most sharply at the point 414*a*, so that its inertial force for breaking away from the inner wall surface of the fuel injection hole 201*a* is largest at the point 414*a*. That is, the point 414*a* is where it is easiest for the fuel to break away from the inner wall surface of the fuel injection hole 201*a*. Also, regarding the fuel flows 410*a* to 412*a*, the fuel changes its flow direction at the point 415*a* more gently than at the point 414*a*. Therefore, at the point 415*a*, it is less easy for the fuel to break away from the inner wall surface of the fuel injection hole 201*a* than at the point 414*a*.

As described above, at the round-chamfered portion 1304*a* of the fuel injection hole inlet 304*a*, the curvature radius of the portion, denoted as the point 414*a*, on the upstream side with respect to the fuel flow is larger than the curvature radius of the portion, denoted as the point 415*a*, on the downstream side with respect to the fuel flow. It is, therefore, possible to suppress breaking away of the fuel from the inner wall surface of the fuel injection hole 201*a* according to the manner in which the fuel flows into the fuel injection hole 201*a*.

As shown in FIG. 4, besides the included angle 308*a* formed between the first plane 11*a* and the second plane 12*a*, an included angle 309*a* is also formed between the first plane 11*a* and the second plane 12*a*, so that, besides the virtual plane 413*a* bisecting the included angle 308*a*, a virtual plane 416*a* bisecting the included angle 309*a* is also conceivable. Furthermore, two points 417*a* and 418*a* are conceivable as points where the round-chamfered portion 1304*a* and the virtual plane 416*a* intersect each other. Determining the curvature radii of the round-chamfered portion 1304*a* requires that at least the portions where it is easiest for the fuel to break away from the inner wall surface of the fuel injection hole 201*a* and where it is least easy for the fuel to break away from the inner wall surface of the fuel injection hole 201*a* be determined. Hence, regarding the present embodiment, the included angle 309*a* and the virtual plane 416*a* will not be particularly referred to in the following.

Referring to FIG. 5A, assume that: extending length L of the fuel injection hole 201*a* equals the length of the injection hole axis 307*a*; and diameter D of the fuel injection hole 201*a* is a diameter at an inner surface 501*a* parallel to the injection hole axis 307*a* of the fuel injection hole 201*a*. In FIG. 5A, reference sign 508*a* denotes the fuel having entered the fuel injection hole 201*a* after flowing along the valve seat surface 203 while breaking away of the fuel is suppressed by the round-chamfered portion 1304*a*.

In the electromagnetic fuel injection valve 100 of the present embodiment, the extending length L and diameter D of the fuel injection hole 201*a* are preferably in a relationship of $L/D \leq 3$. With L/D being 3 or less, the fuel 508*a* having entered the fuel injection hole 201*a* is injected from the fuel injection hole outlet 305*a* without being completely rectified in the fuel injection hole 201*a*. This allows, out of the fuel velocity components at the fuel injection hole outlet 305*a*, velocity components 509*a* spreading in radial directions of the fuel injection hole 201*a* to be made large as shown in FIG. 5B (i.e. the in-plane spreading force of the fuel becomes large). Therefore, out of the fuel velocity components at the fuel injection hole outlet 305*a*, the velocity components in the injection hole axis direction can be made small. This reduces the fuel injection speed at the fuel injection hole outlet 305*a*, so that the distance over which the fuel is sprayed (fuel spray length) is reduced.

Figure 15A:
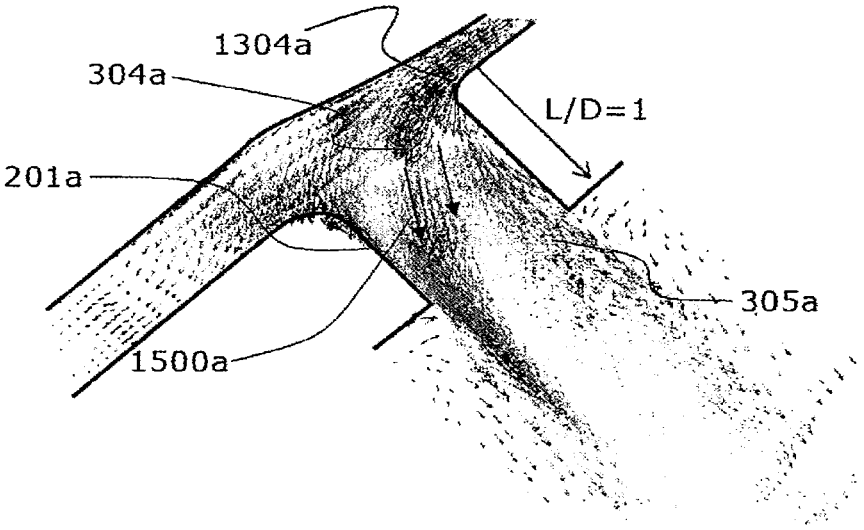
FIGS. 15A-15B diagrams for describing flow rectification effects of L/D.
Figure 15B:
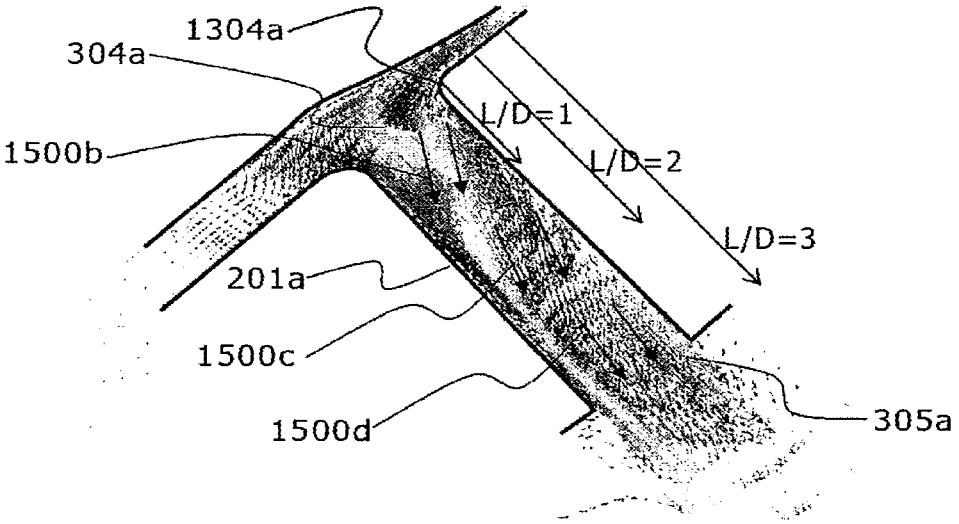

Results of simulations carried out by the present inventors are shown in FIGS. 15A-15B. FIG. 15A shows simulation results obtained with L/D=1, where L is the extending length L of the fuel injection hole 210*a* and D is the diameter D of the injection hole inlet 304. FIG. 15B shows simulation results obtained with L/D=3.

The fuel coming to the injection hole inlet 304 from a fuel sealing section, not shown, located in an upper right portion as seen in each diagram flows into the fuel injection hole passing the round-chamfered portion 1304*a*. When, at this time, L/D is about 1, the fuel is injected, as denoted as 1500*a*, without being rectified in the fuel injection hole. It is shown that, even when L/D is 3, the fuel flow is not completely rectified in a portion corresponding to an L/D value of 1 and that, as the value of L/D increases, the fuel flow is gradually increasingly rectified as denoted by 1500*c* and 1500*d*. If the fuel flow is completely rectified, the velocity components radially spreading in the fuel injection hole reduce to increase the fuel spray length.

That is, for the fuel entering each fuel injection hole 201 via the fuel injection hole inlet 304 thereof to be then injected from the fuel injection hole outlet 305 thereof into a cylinder, L/D≤3 is considered to represent an upper limit value of L/D not to allow the fuel to be completely rectified in the fuel injection hole.

Figure 8A:
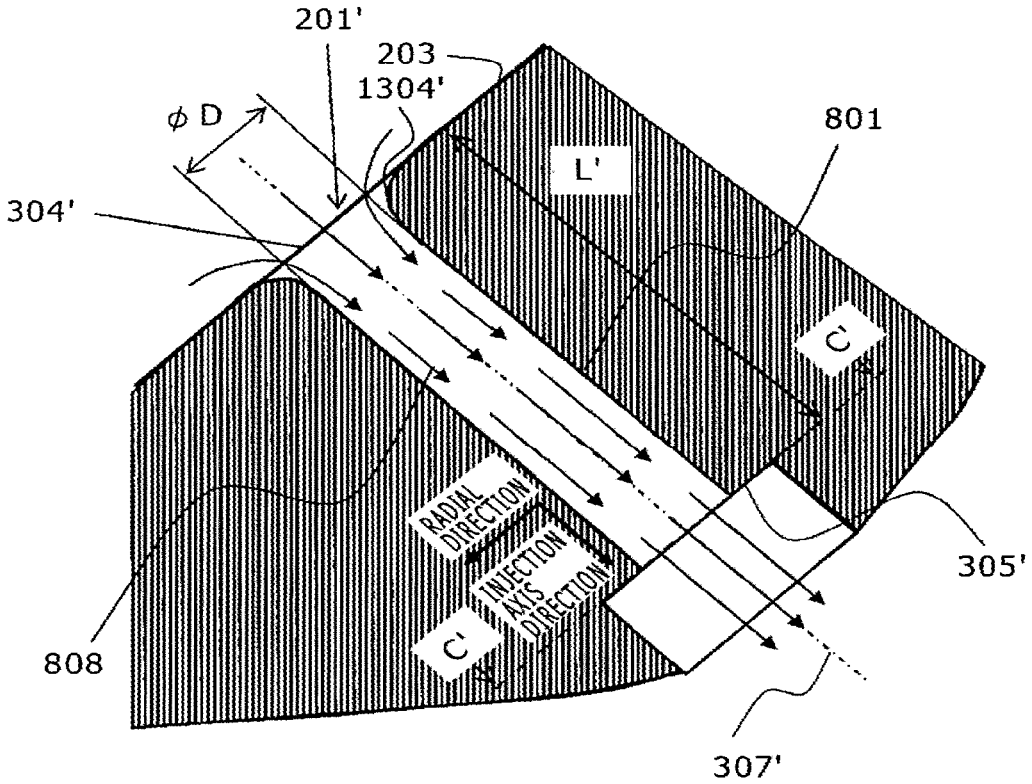
FIGS. 8A-8B show diagrams for describing a case in which a diameter D and an extending length L of a fuel injection hole are in a relationship of L/D>3.

A case in which, as shown in FIG. 8A, an extending length L' of a fuel injection hole 201' is long relative to a diameter D (diameter at an inner surface 801 parallel to an injection hole axis 307' of the fuel injection hole 201') of the fuel injection hole 201' (i.e., a case in which L'/D>3) will be described in the following. As described above, FIGS. 8A and 8B correspond to FIGS. 5A and 5B (b), respectively.

Figure 8B:
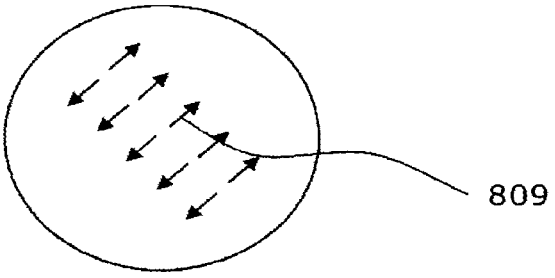

When the value of L'/D is larger than 3, the fuel flowing along the valve seat surface 203 and entering the fuel injection hole 201' while breaking away of the fuel is suppressed by a round-chamfered portion 1304' is rectified, as denoted by 808, while flowing in the fuel injection hole 201'. That is, as shown in FIG. 8B which is a sectional view taken along line C'-C' in FIG. 8A, velocity components 809 radially spreading at an injection hole outlet 305*a*' are reduced (the in-plane spreading force of the fuel is reduced). As a result, the velocity components of the fuel in the injection axis direction become larger to increase the fuel injection speed at the injection hole outlet 305*a* and to increase the fuel spray length.

FIG. 7 shows a curve 701 representing an in-plane spreading force of fuel with the horizontal axis representing L/D and the vertical axis representing the in-plane spreading force of fuel. The in-plane spreading force of fuel is dependent on the radially spreading velocity components at each fuel injection outlet 305. The radially spreading velocity components of fuel at each injection hole outlet 305 are generated when the fuel entering each fuel injection hole 201 is not completely rectified in the fuel injection hole 201. When the value of L/D does not exceed 3, the fuel can be injected, without being completely rectified, from each fuel injection hole outlet 305. This reduces the fuel spray length.

Figure 9A:
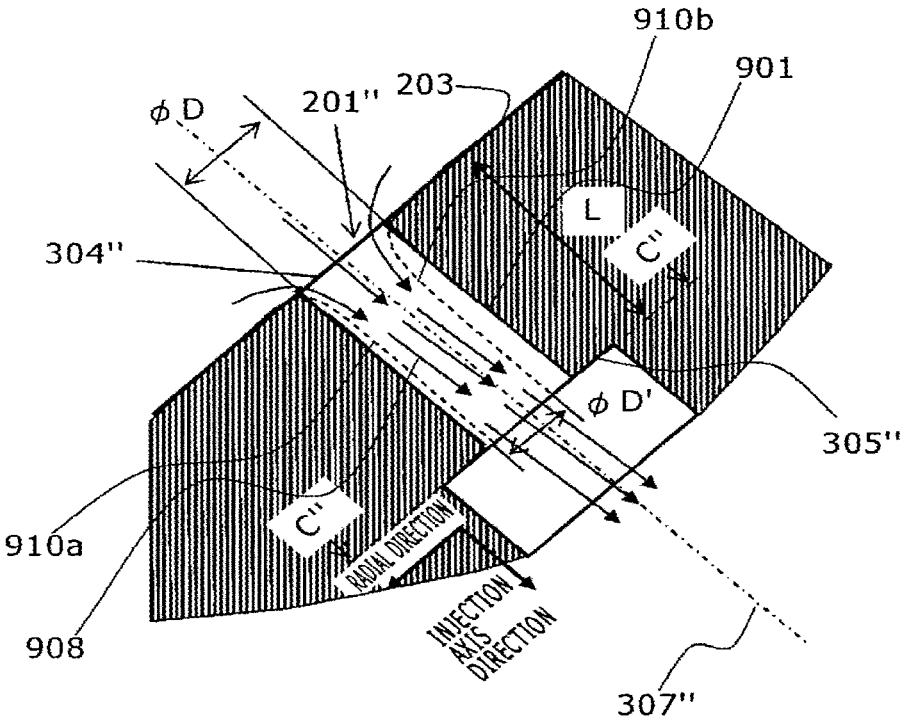
FIGS. 9A-9B show diagrams for describing a case with no round-chamfered portion provided at a fuel injection hole inlet.

A case in which, as shown in FIG. 9A, no round-chamfered portion 1304 of the present embodiment is provided at a fuel injection hole inlet 304" will be described. Assume that a diameter D of a fuel injection hole 201" (the diameter of the fuel injection hole 201" at an inner surface 901) and an extending length L of the fuel injection hole 201" shown in FIG. 9A are, to be similar to the present embodiment described above, in a relationship of L/D≤3. Also, as described above, FIGS. 9 and 9 correspond to FIGS. 5A and 5B, respectively.

Even with an L/D value of 3 or less, when the fuel injection hole inlet 304" has no round-chamfered portion 1304, the fuel breaks away from the inner wall surface 901 of the fuel injection hole 201" as shown in FIG. 9A. Reference signs 910*a* and 910*b* denote boundaries between the fuel flow and spaces inside the fuel injection hole 201". The space formed between the fuel flow boundaries 910*a* and 910*b* and the inner wall surface 901 of the fuel injection hole 201" are broken-away areas formed by breaking away of the fuel.

Figure 9B:
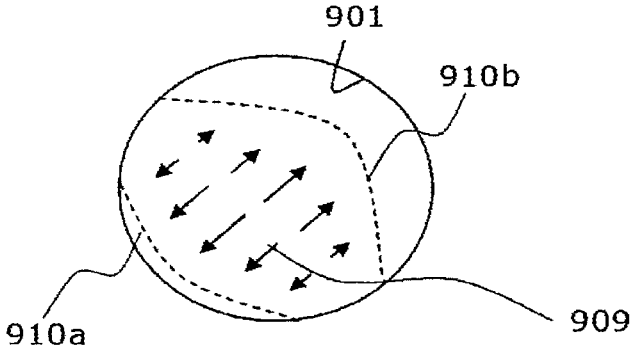

In the examples shown in FIGS. 9A and 9B, the value of L/D is 3 or less, so that fuel 908 having entered the fuel injection hole 201" is injected from a fuel injection hole outlet 305" without being completely rectified in the fuel injection hole 201". However, the cross-sectional area of the fuel 908 flowing in the fuel injection hole 201" is smaller than the cross-sectional area of the fuel injection hole 201" by a total cross-sectional area of the broken-away areas formed inside the fuel injection hole 201". This practically reduces the area of the fuel injection hole outlet 305" (the cross-sectional area of the fuel injection hole 201"), so that the fuel injection speed increases. That is, the velocity components in the direction of the injection hole axis of the fuel increase resulting in a higher speed of fuel injection from the fuel injection hole outlet 305". As a result, the fuel spray length increases. Thus, merely setting a small L/D value does not reduce the fuel spray length.

In FIG. 9B, the arrows representing velocity components are shown deviated from the cross-sectional center of the fuel injection hole. This is because of the difference, caused by breaking away of the fuel as shown in FIG. 9A, between the distance from the fuel flow boundary 901*a* on the downstream side to the inner surface 901 and the distance from the fuel flow boundary 901*b* on the upstream side to the inner surface 901.

Orientations of Injection Hole Axes 307*a* to 307*f*

The orientations of injection hole axes 307*a* to 307*f* will be described with reference to FIG. 6. In the present embodiment, the injection hole axes 307*a* to 307*f* are oriented along the generatrix of either one of two virtual circular cones sharing a vertex and an axis and having different vertex angles. In the following description, of the two virtual circular cones, the one with a smaller vertex angle will be represented by reference sign 601 and the other one with a larger vertex angle will be represented by reference sign 602.

The injection hole axes 307*a*, 307*c*, and 307*e* are oriented along the generatrix of the virtual circular cone 601 that has a vertex on the central axis 204 (not shown in FIG. 6) of the electromagnetic fuel injection valve 100 and a central axis coinciding with the central axis 204. The injection hole axes 307*b*, 307*d*, and 307*f* are oriented along the generatrix of the virtual circular cone 602 that shares the vertex and axis with the virtual circular cone 601 and has a vertex angle larger than that of the virtual circular cone 601. Thus, in the present embodiment, the lines 307 respectively connecting the center points 302 of the fuel injection hole inlets 304 and the center points 306 of the fuel injection hole outlets 305 of the respective fuel injection holes 201 are oriented along the conical surface of either one of the two virtual circular cones 601 and 602.

Operational Effects

The electromagnetic fuel injection valve 100 of the present embodiment described above renders the following operational effects:

(1) Each fuel injection hole inlet 304 has a round-chamfered portion 1304, and the extending length L of the fuel injection hole 201*a* and the diameter D of the fuel injection hole 201*a* are in a relationship of L/D≤3. This prevents breaking away of the fuel inside each fuel injection hole 201, so that the area of each fuel injection hole outlet 305 (cross-sectional area of each fuel injection hole 201) can be prevented from being practically reduced and so that the fuel injection speed can be prevented from increasing. Hence, the fuel spray length can be effectively prevented from increasing and, at the time of fuel injection into a cylinder, fuel adhesion to a suction valve or the inner wall surface of the cylinder can be effectively suppressed.

(2) The round-chamfered portion 1304 of each fuel injection hole inlet 304 is formed such that a point denoted as 414 on the upstream side with respect to the fuel flow has a larger curvature radius than that of a point denoted as 415 on the downstream side with respect to the fuel flow. This makes it possible to effectively prevent, according to the manner in which the fuel flows into each fuel injection hole 201, the fuel from breaking away from the inner wall surface of each fuel injection hole 201. Therefore, at the time of fuel injection into a cylinder, fuel adhesion to a suction valve or the inner wall surface of the cylinder can be effectively suppressed.

(3) Two points where a virtual plane 413 bisecting an included angle 308 and a round-chamfered portion 1304 intersect each other are determined and, of the two points, the one on the upstream side with respect to the fuel flow has a curvature radius larger than that of the other point on the downstream side with respect to the fuel flow. In this way, the radius curvature of the round-chamfered portion 1304 can be appropriately set according to the manner in which the fuel comes in. This makes it possible to securely prevent breaking away of the fuel in each fuel injection hole 201. Therefore, at the time of fuel injection into a cylinder, fuel adhesion to a suction valve or the inner wall surface of the cylinder can be securely suppressed.

(4) Each fuel injection hole inlet 304 is formed on the inner conical surface of the seat member 102. This allows the fuel flow toward the fuel injection hole inlet 304 to be rectified along the conical surface, so that the curvature radii of different portions of the opening edge of the round-chamfered portion 1304 can be set with ease and so that breaking away of the fuel from the inner wall surface of each fuel injection hole 201 can be effectively prevented according to the manner in which the fuel flows into the fuel injection hole 201. Therefore, at the time of fuel injection into a cylinder, fuel adhesion to a suction valve or the inner wall surface of the cylinder can be effectively suppressed.

(5) The valve seat surface 203 is formed on the conical inner surface of the seat member 102. This, combined with the effects of the fuel injection hole inlets 304 formed on the inner surface of the seat member 102, allows the fuel flow toward the fuel injection hole inlets 304 to be rectified along the conical surface. Therefore, as described above, breaking away of the fuel from the inner wall surface of each fuel injection hole 201 can be effectively prevented according to the manner in which the fuel flows into the fuel injection hole 201. Hence, at the time of fuel injection into a cylinder, fuel adhesion to a suction valve or the inner wall surface of the cylinder can be effectively suppressed.

(6) The injection hole axes 307*a* to 307*f* are oriented along the generatrix of either one of the two virtual circular cones 601 and 602 that share a vertex and an axis and have different vertex angles. This makes it possible to generate diversified fuel spray shapes. Thus, superior layoutability is offered for fuel injection into an internal combustion engine.

Second Embodiment

Figure 10:
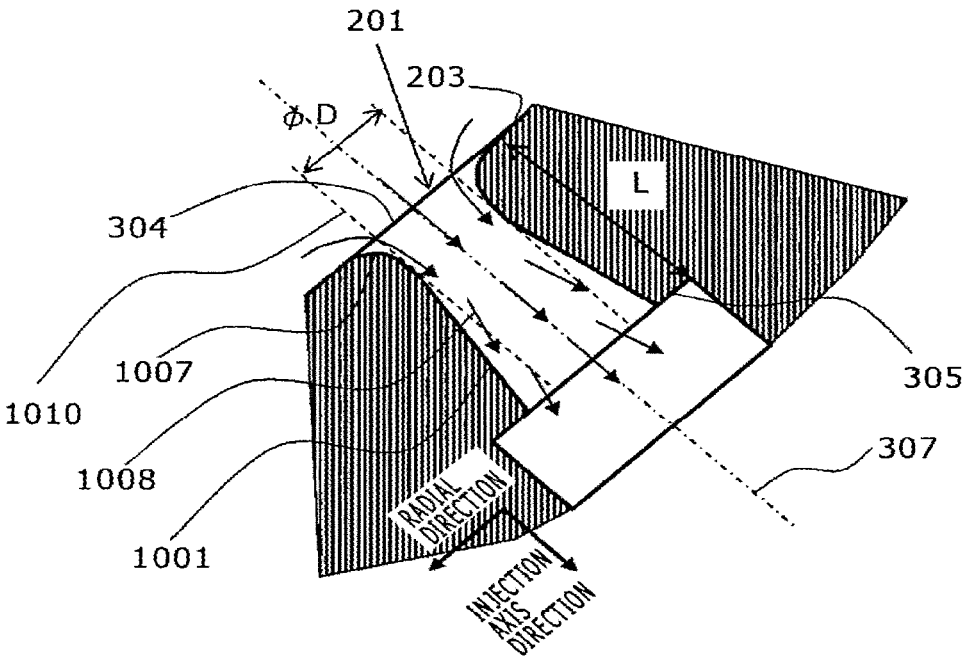
FIG. 10 is a diagram for describing an electromagnetic fuel injection valve according to a second embodiment.

A spark-ignition direct fuel injection valve according to a second embodiment of the present invention will be described below with reference to FIG. 10. In the following description, the constituent elements identical to those used in the first embodiment will be represented by the corresponding reference signs used in describing the first embodiment, and they will be described centering on differences from the first embodiment. Their aspects not particularly described in the following are the same as in the first embodiment. FIG. 10 is a sectional view showing a structure of the electromagnetic fuel injection valve 100 according to the second embodiment and corresponds to FIG. 5A.

In the electromagnetic injection valve 100 of the second embodiment, a side surface 1001 of each fuel injection hole is configured such that the cross-sectional area is gradually larger from the fuel injection hole inlet 304 toward the fuel injection hole outlet 305. In the second embodiment, diameter D of each fuel injection hole 201 represents a diameter 1010 measured at a boundary between a round-chamfered portion 1007 of the fuel injection hole inlet 304 and the fuel injection hole side surface 1001 (the boundary being where the cross-sectional area of the fuel injection hole 201 is smallest).

In the electromagnetic fuel injection valve 100 of the second embodiment, fuel 1008 flowing into each fuel injection hole 201 from the valve seat surface 203 along the round-chamfered portion 1007 without breaking away is, after radially spreadingly flowing in the fuel injection hole 201, injected from the fuel injection hole outlet 305. Therefore, it is possible to suppress the velocity components in the injection hole axis direction by increasing the radially spreading velocity components. In this way, the fuel spray length can be further reduced compared with the case of the electromagnetic fuel injection valve 100 of the first embodiment, so that, at the time of fuel injection into a cylinder, fuel adhesion to a suction valve and the inner wall surface of the cylinder can be effectively suppressed.

In the other respects, the fuel injection valve of the second embodiment is structured identically to the fuel injection valve of the first embodiment. For example, the opening inlet edge of each injection hole 201 is round-chamfered, and the upstream point 414*a* (see FIG. 4) has a curvature radius larger than that of the downstream point 415*a* (see FIG. 4).

Third Embodiment

Figure 11:
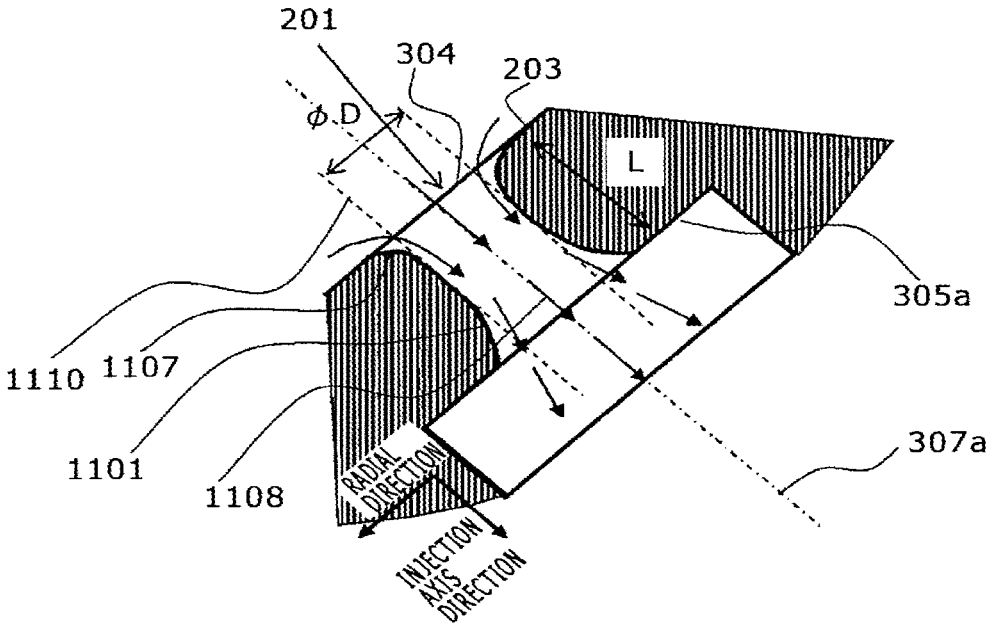
FIG. 11 is a diagram for describing an electromagnetic fuel injection valve according to a third embodiment.

A spark-ignition direct fuel injection valve according to a third embodiment of the present invention will be described below with reference to FIG. 11. In the following description, the constituent elements identical to those used in the first embodiment will be represented by the corresponding reference signs used in describing the first embodiment, and they will be described centering on differences from the first embodiment. Their aspects not particularly described in the following are the same as in the first embodiment. FIG. 11 is a sectional view showing a structure of the electromagnetic fuel injection valve 100 according to the third embodiment and corresponds to FIG. 5A.

In the electromagnetic fuel injection valve 100 of the third embodiment, each fuel injection hole inlet 304 has a round-chamfered portion 1107 and each fuel injection hole outlet 305 has a round-chamfered portion 1101. A downstream end portion of the round-chamfered portion 1107 and an upstream end portion of the round-chamfered portion 1101 coincide with each other. In the third embodiment, diameter D of each fuel injection hole 201 represents diameter 1110 at a boundary (where the cross-sectional area of the fuel injection hole 201 is smallest) between the round-chamfered portion 1107 and the round-chamfered portion 1101, the boundary being the downstream end portion of the round-chamfered portion 1107 and also the upstream end portion of the round-chamfered portion 1101.

Unlike for the round-chamfered portion 1107 of each fuel injection hole inlet 304, it is not necessary, for the round-chamfered portion 1101 of each fuel injection hole outlet 305, to set appropriately varied radii of curvature for different portions of the opening edge for the fuel flow. The round-chamfered portion 1101 may have a uniform radius of curvature.

In the electromagnetic fuel injection valve 100 of the third embodiment, fuel 1108 having entered, without breaking away, each fuel injection hole 201 from the valve seat surface 203 and along the round-chamfered portion 1107 is injected from the fuel injection hole outlet 305 after radially spreadingly flowing over the round-chamfered portion 1108. Therefore, it is possible to suppress the velocity components in the injection hole axis direction by increasing the radially spreading velocity components. In this way, the fuel spray length can be further reduced compared with the case of the electromagnetic fuel injection valve 100 of the first embodiment, so that, at the time of fuel injection into a cylinder, fuel adhesion to a suction valve and the inner wall surface of the cylinder can be effectively suppressed.

Fourth Embodiment

Figure 12:
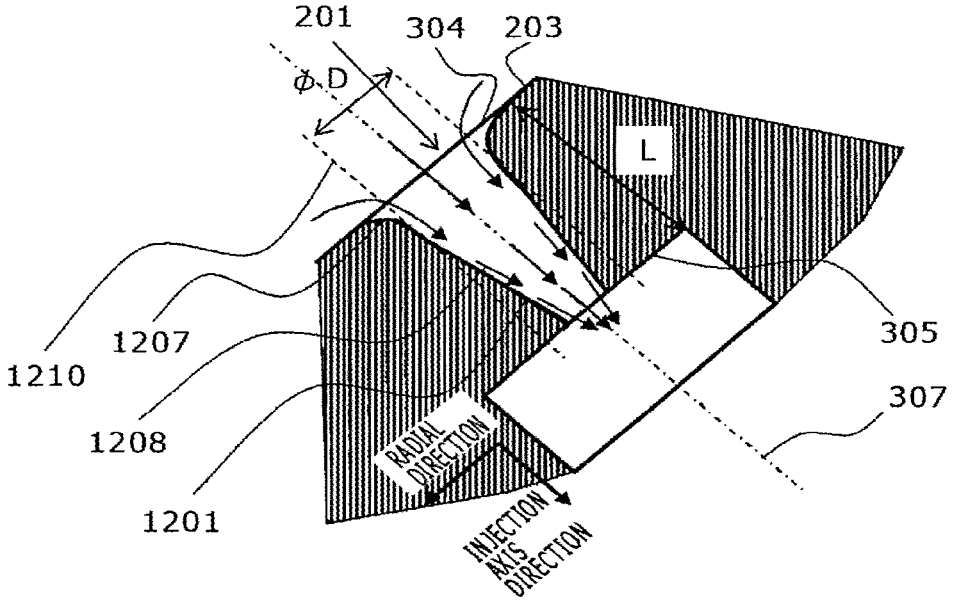
FIG. 12 is a diagram for describing an electromagnetic fuel injection valve according to a fourth embodiment.

A spark-ignition direct fuel injection valve according to a fourth embodiment of the present invention will be described below with reference to FIG. 12. In the following description, the constituent elements identical to those used in the first embodiment will be represented by the corresponding reference signs used in describing the first embodiment, and they will be described centering on differences from the first embodiment. Their aspects not particularly described in the following are the same as in the first embodiment. FIG. 12 is a sectional view showing a structure of the electromagnetic fuel injection valve 100 according to the forth embodiment and corresponds to FIG. 5A.

In the electromagnetic fuel injection valve 100 of the fourth embodiment, a side surface 1201 of each fuel injection hole is configured such that the cross-sectional area is gradually smaller from the fuel injection hole inlet 304 toward the fuel injection hole outlet 305. In the fourth embodiment, diameter D of each fuel injection hole 201 represents a diameter 1210 measured at a boundary between a round-chamfered portion 1207 of the fuel injection hole inlet 304 and the fuel injection hole side surface 1201. In the electromagnetic fuel injection valve 100 of the fourth embodiment, fuel 1208 flowing into each fuel injection hole 201 from the valve seat surface 203 along the round-chamfered portion 1207 without breaking away is, after radially convergingly flowing along the fuel injection hole side surface 1201, injected from the fuel injection hole outlet 305.

Therefore, in the fourth embodiment compared with the first to third embodiments, the fuel velocity components spreading in the radial directions of each fuel injection hole 201 are suppressed to some extent. With the value of L/D not exceeding 3, however, the fuel 1208 entering each fuel injection hole 201 is injected from the fuel injection hole outlet 305 without being completely rectified in the fuel injection hole 201. Therefore, of the fuel velocity components at the fuel injection hole outlet 305, the velocity components spreading in the radial directions of the fuel injection hole 201 become larger whereas the velocity components in the injection hole axis direction become smaller. Hence, the speed at which the fuel is injected from the fuel injection hole outlet 305 decreases causing the fuel spray length to be reduced, so that, at the time of fuel injection into a cylinder, fuel adhesion to a suction valve and the inner wall surface of the cylinder can be effectively suppressed.

Also, in the electromagnetic injection valve 100 of the fourth embodiment, the overall flow rate in the electromagnetic fuel injection valve 100 can be suppressed. Therefore, the electromagnetic fuel injection valve 100 of the fourth embodiment can be easily applied to an internal combustion engine with a small displacement.

Fifth Embodiment

Figure 13:
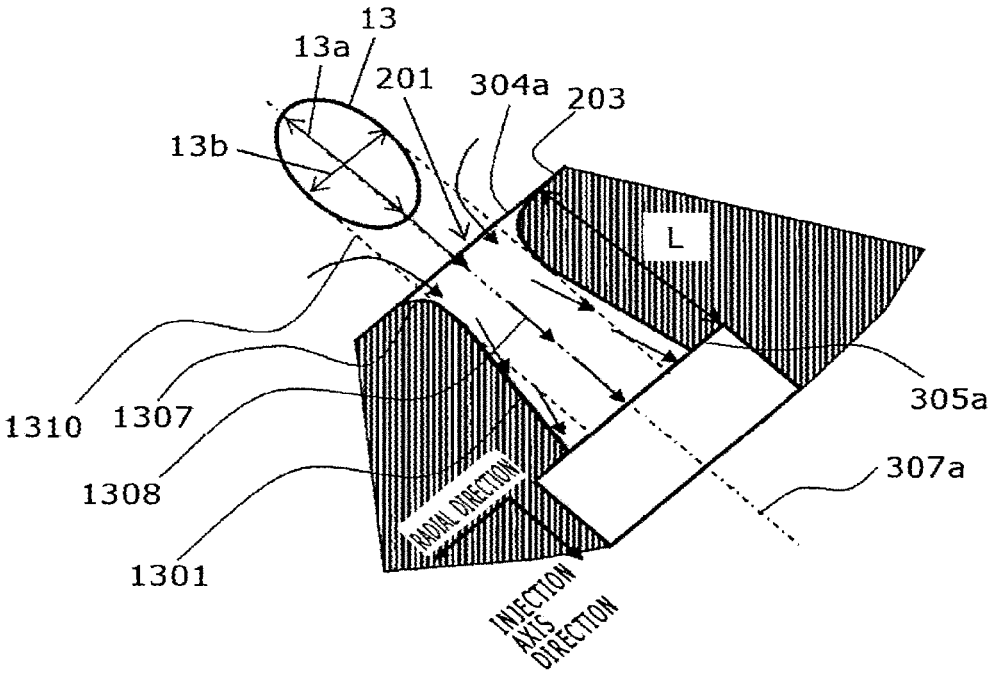
FIG. 13 is a diagram for describing an electromagnetic fuel injection valve according to a fifth embodiment.

A spark-ignition direct fuel injection valve according to a fifth embodiment of the present invention will be described below with reference to FIG. 13. In the following description, the constituent elements identical to those used in the first embodiment will be represented by the corresponding reference signs used in describing the first embodiment, and they will be described centering on differences from the first embodiment. Their aspects not particularly described in the following are the same as in the first embodiment. FIG. 13 is a sectional view showing a structure of the electromagnetic fuel injection valve 100 according to the fifth embodiment and corresponds to FIG. 5A.

In the electromagnetic fuel injection valve 100 of the fifth embodiment, each fuel injection hole 201 has an elliptical cross-section. In the fifth embodiment, diameter D of each fuel injection hole 201 represents a diameter 1310 of a circle which equals in area a cross-sectional ellipse 13 at a boundary between a round-chamfered portion 1307 of the fuel injection hole inlet 304 and a side surface 1301 of the fuel injection hole 201 (the boundary being where the cross-sectional area of the fuel injection hole 201 is smallest). The ellipse 13 has a major axis 13*a* and a minor axis 13*b*.

In the electromagnetic fuel injection valve 100 of the fifth embodiment, the elliptical fuel injection hole inlet 304 is oriented such that the major axis 13*a* is approximately perpendicular to the fuel flow from the upstream side (upper right side as seen in the diagram) of the valve seat surface 203. That is, the fuel injection hole inlet 304 is widely open to the fuel flowing in from the upstream side of the valve seat surface 203. In this way, as compared with when the fuel injection hole inlet 304 is truly circular, breaking away of the fuel in the fuel injection hole 201 can be effectively suppressed. Furthermore, fuel 1308 flowing into the fuel injection hole 201 through the fuel injection hole inlet 304 without breaking away from the round-chamfered portion 1307 is ejected from the fuel injection hole outlet 305 after radially spreadingly flowing in the fuel injection hole 201. It is, therefore, possible to suppress the fuel velocity components in the injection hole axis direction by increasing the radially spreading fuel velocity components. In this way, compared with the case of the electromagnetic fuel injection valve 100 of the second embodiment in which the side surface of each fuel injection hole is formed such that the cross-sectional area of the fuel injection hole is increasingly larger from the fuel injection hole inlet toward the fuel injection hole outlet, the fuel spray length can be further reduced. Hence, at the time of fuel injection into a cylinder, fuel adhesion to a suction valve and the inner wall surface of the cylinder can be effectively suppressed.

In the present embodiment, even if the diameter of each fuel injection hole 201 is made uniform as in the electromagnetic fuel injection valve 100 of the first embodiment, similar operational effects to those described above can be achieved. Also, in the present embodiment, even if a round-chamfered portion is provided at each of the inlet and outlet of each fuel injection hole as in the electromagnetic fuel injection valve 100 of the third embodiment, similar operational effects to those described above can be achieved.

Furthermore, in the present embodiment, even if the side surface of each fuel injection hole is formed such that the cross-sectional area of the fuel injection hole is gradually smaller from the fuel injection hole inlet toward the fuel injection hole outlet as in the electromagnetic fuel injection valve 100 of the fourth embodiment, similar operational effects to those described above can be achieved.

Sixth Embodiment

Figure 14:
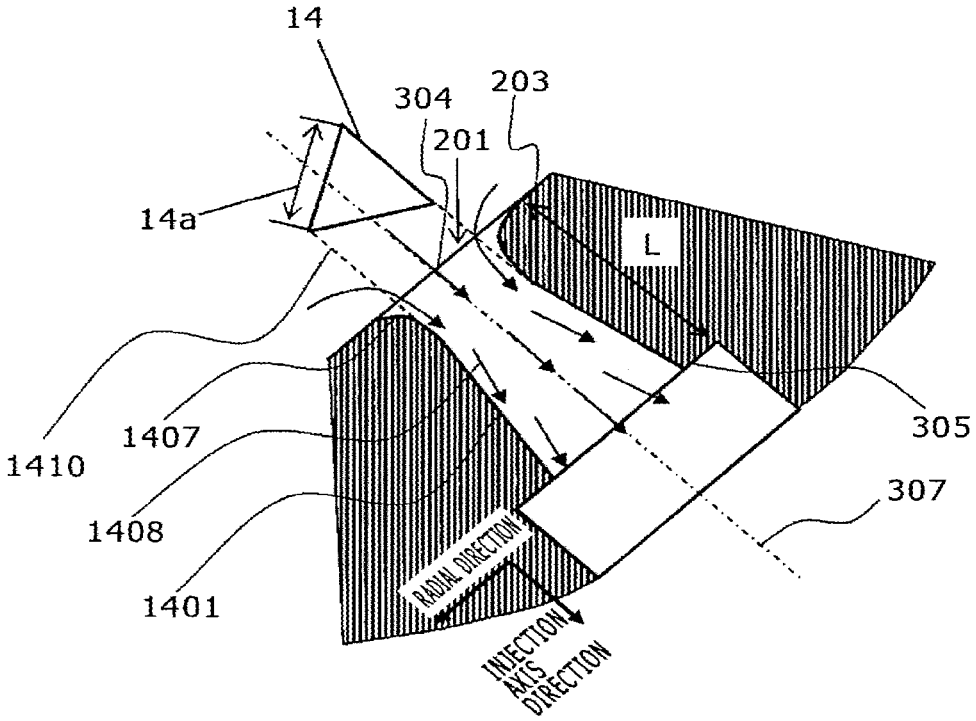
FIG. 14 is a diagram for describing an electromagnetic fuel injection valve according to a sixth embodiment.

A spark-ignition direct fuel injection valve according to a sixth embodiment of the present invention will be described below with reference to FIG. 14. In the following description, the constituent elements identical to those used in the first embodiment will be represented by the corresponding reference signs used in describing the first embodiment, and they will be described centering on differences from the first embodiment. Their aspects not particularly described in the following are the same as in the first embodiment. FIG. 14 is a sectional view showing a structure of the electromagnetic fuel injection valve 100 according to the sixth embodiment and corresponds to FIG. 5A.

In the electromagnetic injection valve 100 of the sixth embodiment, the cross-sectional shape of each fuel injection hole 201 is approximately triangular. In the sixth embodiment, diameter D of each fuel injection hole 201 represents a diameter 1410 of a circle which equals in area a cross-sectional triangle 14 at a boundary between a round-chamfered portion 1407 of the fuel injection hole inlet 304 and a fuel injection hole side surface 1401 (the boundary being where the cross-sectional area of the fuel injection hole 201 is smallest). The triangle 14 is an equilateral triangle having a side 14*a*.

In the electromagnetic fuel injection valve 100 of the sixth embodiment, the triangular fuel injection hole inlet 304 of each fuel injection hole is oriented such that the side 14*a* is approximately perpendicular to the fuel flow from the upstream side (upper right side as seen in the diagram) of the valve seat surface 203. That is, the fuel injection hole inlet 304 is widely open to the fuel flowing in from the upstream side of the valve seat surface 203. In this way, as compared with when the fuel injection hole inlet 304 is truly circular, breaking away of the fuel in the fuel injection hole 201 can be effectively suppressed. Furthermore, fuel 1408 flowing into the fuel injection hole 201 through the fuel injection hole inlet 304 without breaking away from the round-chamfered portion 1407 is ejected from the fuel injection hole outlet 305 after radially spreadingly flowing in the fuel injection hole 201. It is, therefore, possible to suppress the fuel velocity components in the injection hole axis direction by increasing the radially spreading fuel velocity components. In this way, compared with the case of the electromagnetic fuel injection valve 100 of the second embodiment in which the side surface of each fuel injection hole is formed such that the cross-sectional area of the fuel injection hole is increasingly larger from the fuel injection hole inlet toward the fuel injection hole outlet, the fuel spray length can be further reduced. Hence, at the time of fuel injection into a cylinder, fuel adhesion to a suction valve and the inner wall surface of the cylinder can be effectively suppressed.

In the present embodiment, even if the diameter of each fuel injection hole 201 is made uniform as in the electromagnetic fuel injection valve 100 of the first embodiment, similar operational effects to those described above can be achieved. Also, in the present embodiment, even if a round-chamfered portion is provided at each of the inlet and outlet of each fuel injection hole as in the electromagnetic fuel injection valve 100 of the third embodiment, similar operational effects to those described above can be achieved. Furthermore, in the present embodiment, even if the side surface of each fuel injection hole is formed such that the cross-sectional area of the fuel injection hole is gradually smaller from the fuel injection hole inlet toward the fuel injection hole outlet as in the electromagnetic fuel injection valve 100 of the fourth embodiment, similar operational effects to those described above can be achieved.

MODIFICATIONS (1) By taking into consideration the distances between the electromagnetic fuel injection valve 100 and the top, bottom and side surfaces of a cylinder of an internal combustion engine, the curvature radius of the round-chamfered portion 1304 may be varied along the circumference of the opening edge of the fuel injection hole inlet 304 so as to make appropriate the fuel spray lengths toward the top, bottom and side surfaces of the internal combustion engine cylinder. In this way, a suitable state of air-fuel mixture can be achieved in the cylinder while suppressing fuel adhesion to a suction valve and the inner wall surface of the cylinder.

(2) Preferably, the curvature radius of the round-chamfered portion 1304 is set to gradually vary along the circumferential direction of the opening edge of the fuel injection hole inlet 304. It is, however, sufficient if the chamfered portion 1304 has at least a difference in curvature radius between the upstream side and the downstream side with respect to the fuel flow. Even if the curvature radius of the chamfered portion 1304 sharply or discontinuously changes along the circumferential direction of the opening edge, the operational effects of the present invention are not detracted from. Also, the opening edge of the fuel injection hole inlet 304 is required to be chamfered at least on the upstream side with respect to the fuel flow. Chamfering on the downstream side is not imperative.

(3) The fuel injection hole inlet 304 can be provided with the round-chamfered portion 1304 at the opening edge thereof, for example, by letting a liquid containing dispersed abrasive grains flow therethrough or by blasting the opening edge. Alternatively, the opening edge portion the curvature radius of which is not to be increased may be hardened by heat treatment so as to increase the abrasion resistance of the portion and so as to, thereby, generate a curvature radius difference between the portion and the other portion not subjected to such heat treatment.

(4) In the above description, whether or not the distance between the center point 302 of the fuel injection hole inlet 304 of each fuel injection hole 201 and the central axis 204 of the electromagnetic fuel injection valve 100 is different between the fuel injection holes 201 and whether or not the adjacent fuel injection holes 201 are equidistantly spaced apart are not mentioned. However, whether or not the distance between the center point 302 of the fuel injection hole inlet 304 of each fuel injection hole 201 and the central axis 204 of the electromagnetic fuel injection valve 100 is different between the fuel injection holes 201 does not detract from the above-described operational effects. Also, whether or not the adjacent fuel injection holes 201 are equidistantly spaced apart does not detract from the above-described operational effects.

(5) Even though the above description is based on the assumption that the number of the fuel injection holes 201 formed through the seat member 102 is six, the present invention does not limit the number of the fuel injection holes 201 to six. That is, even if the number of the fuel injection holes 201 formed through the seat member 102 is not six, operational effects similar to those of the above embodiments can be achieved.

(6) According to the above description, the fuel injection hole axes 307*a* to 307*f* are oriented based on two virtual cones 601 and 602. However, the present invention does not limited the number of the virtual cones to two. For example, the number of the virtual cones may be 3 or more.

(7) The above embodiments and the modifications may be combined.

The present invention is not limited to the above embodiments and can be applied to various types of spark-ignition direct fuel injection valves.

LIST OF REFERENCE SIGNS

| | |
|---|---|
| 100 | Electromagnetic fuel injection valve |
| 101 | Valve body |
| 102 | Seat member |
| 201 (201a to 201f) | Fuel injection holes |
| 202 | Spherical portion |
| 203 | Valve seat surface |
| 204 | Axis of valve body 101 (central axis of electromagnetic fuel injection valve 100) |
| 304 (304a to 304f) | Fuel injection hole inlets |
| 305 (305a to 305f) | Fuel injection hole outlets |
| 1304 (1304a to 1304f) | Round-chamfered portions |

What is claimed is:

1. A spark-ignition direct fuel injection valve, comprising, a seat member provided with a fuel injection hole; and a valve body which controls fuel injection from the fuel injection hole by selectively contacting and separating from a valve seat, wherein the fuel injection hole has a fuel injection hole inlet which is open inwardly of the seat member and a fuel injection hole outlet which is open outwardly of the seat member, wherein an opening edge of the fuel injection hole inlet of the fuel injection hole has a round-chamfered portion, wherein the seat member has an expanded opening which is expanded in cross sectional area outwardly from the fuel injection hole outlet such that a distance from a front end side of the seat member to a side wall portion on the front end side of the extended opening is a same distance as a distance from an end side opposite to the front-end side to a side wall portion opposite to the front end side of the extended opening, wherein a length of the fuel injection hole is longer than a length of the expanded opening in an injection axis direction, wherein the cross-sectional area of the fuel injection hole is continuously smaller from the round-chamfered portion of the fuel injection hole inlet to the fuel injection hole outlet, wherein a width of the expanded opening in a radial direction is formed larger than a width of an end of the round-chamfered portion, wherein the expanded opening expands stepwise outwardly from the fuel injection hole outlet, and has a cross-sectional area of a single rectangle, wherein a width of a side of the single rectangle that extends in the radial direction is larger than a width of an outer end of the round-chamfered portion, and wherein the fuel injection hole outlet is separated by a distance from a side of the single rectangle that extends perpendicular to the radial direction, and a width of the fuel injection hole outlet is smaller than the distance.

2. The spark-ignition direct fuel injection valve according to claim 1, wherein an extending length of the fuel injection hole is three or less times a hole diameter of the fuel injection hole.

3. The spark-ignition direct fuel injection valve according to claim 1, wherein the fuel injection hole has a diameter D measured at a boundary between the round-chamfered portion and a side surface of the fuel injection hole, the fuel injection hole has a length L, and a relationship $L/D \leq 3$ is satisfied.

* * * * *